United States Patent [19]

Price

[11] 4,318,700

[45] Mar. 9, 1982

[54] PADDLE WHEEL OPERATED WATERCRAFT

[76] Inventor: Charles D. Price, 78 Sylvan Rd., South Windham, Me. 04082

[21] Appl. No.: 138,591

[22] Filed: Apr. 9, 1980

[51] Int. Cl.[3] ..... B63H 16/12

[52] U.S. Cl. ..... 440/26; 114/58; 114/61; 114/144 R; 114/363

[58] Field of Search ..... 114/58, 123, 283, 292, 114/61, 144 R; 440/25, 90, 91, 92, 93, 250; 9/7; 297/383

[56] References Cited

U.S. PATENT DOCUMENTS

| | | | |
|---|---|---|---|
| 1,691,396 | 11/1928 | Lindstrom . | |
| 1,738,979 | 12/1929 | Adelmann | 114/283 |
| 2,036,185 | 4/1936 | Baker . | |
| 2,299,737 | 10/1942 | Clark . | |
| 2,369,973 | 2/1945 | Montalbano | 440/90 X |
| 2,784,769 | 3/1957 | Fisher | 297/383 X |
| 2,824,539 | 2/1958 | Budney et al. | 440/26 |
| 3,027,863 | 4/1962 | Town | 440/92 X |
| 3,031,692 | 5/1962 | Riek . | |
| 3,083,382 | 4/1963 | Havens et al. | 114/61 X |
| 3,090,339 | 5/1963 | Carr | 114/292 |
| 3,180,306 | 4/1965 | Govedy . | |
| 3,450,084 | 6/1969 | Gerbracht | 114/123 |
| 3,866,557 | 2/1975 | Lang | 114/61 |
| 3,884,522 | 5/1975 | Arima et al. | 9/7 X |
| 4,140,076 | 2/1979 | Borglum | 114/283 |

FOREIGN PATENT DOCUMENTS

| | | | |
|---|---|---|---|
| 11239 | 12/1909 | France | 114/283 |
| 15037 | 6/1909 | United Kingdom | 114/283 |

*Primary Examiner*—Trygve M. Blix
*Assistant Examiner*—Stephen P. Avila

[57] ABSTRACT

A watercraft has two pontoons interconnected by framework which supports a propelling unit adjacent its bow end. The unit includes a paddle wheel between the two pontoons with exposed pedals to be engaged by the feet of a seated occupant. A rudder is attached to the stern end of the framework to an intermediate portion of which a seating unit is attached adjacent which the rudder control is located. An outboard motor may be attached to the rear end of the framework and the seating unit, constructed to enable the watercraft to accommodate two persons seated back-to-back, is adjustable lengthwise of the framework.

8 Claims, 12 Drawing Figures

Fig. 8
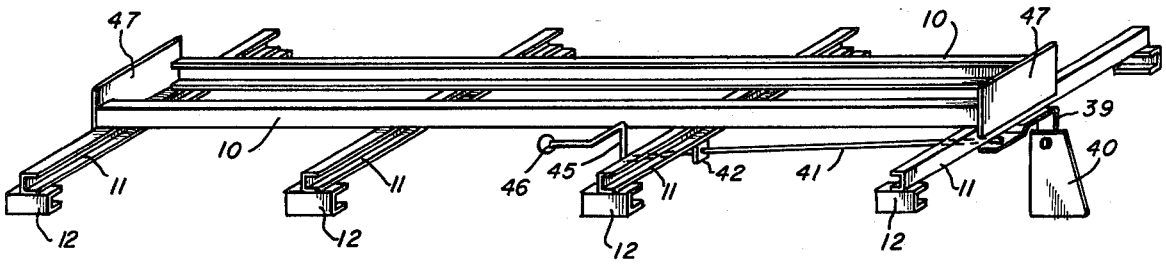
Fig. 9
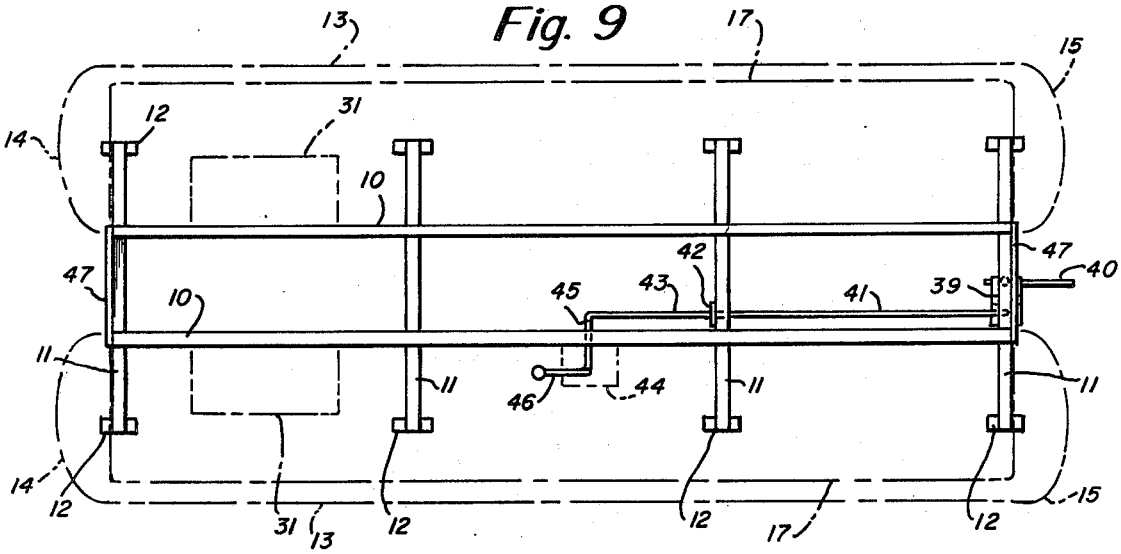
Fig. 10
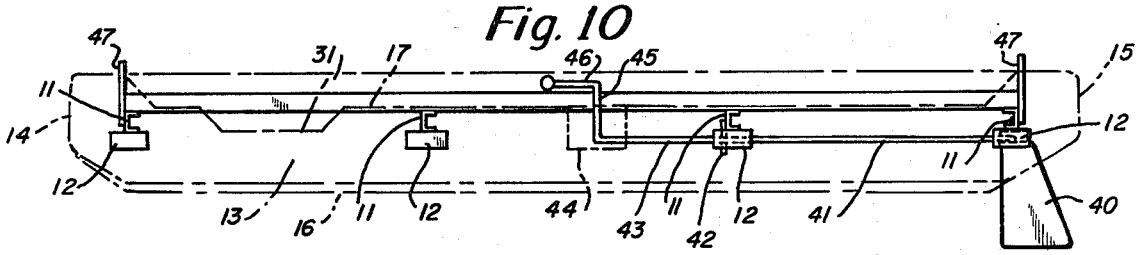
Fig. 11
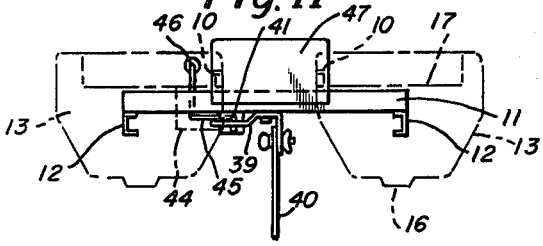
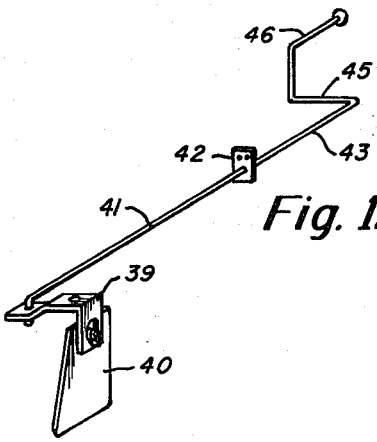
Fig. 12

PADDLE WHEEL OPERATED WATERCRAFT

BACKGROUND REFERENCES

U.S. Pat. No. 1,691,396
U.S. Pat. No. 2,036,185
U.S. Pat. No. 2,299,737
U.S. Pat. No. 3,031,692
U.S. Pat. No. 3,045,636
U.S. Pat. No. 3,180,306
U.S. Pat No. 3,410,244

BACKGROUND OF THE INVENTION

For many years, watercraft have been proposed that utilized manually operated paddle wheels.

One type of such watercraft had two pontoons interconnected in a spaced, side-by-side relationship. In some watercraft of this type, the use of two paddle wheels was proposed, each on the outside of the appropriate one of the pontoons while in others, a single, pedal-operated paddle wheel was located between the pontoons adjacent the stern ends thereof.

The last named, single paddle wheel type has many potential advantages for warm weather use because of the ease with which such watercraft may be propelled and because of their typical shallow draft.

THE PRESENT INVENTION

The general objective of the present invention is to provide watercraft of the single, pedal operated type adapted for a wide range of uses.

In accordance with the invention, this general objective is attained with a watercraft having a light weight frame consisting of two spaced parallel lengthwise members and a plurality of transverse members provided with anchors at their ends embedded in the appropriate ones of the two pontoons while molded from an expanding plastic material that provides both adequate flotation and a hard outer shell or skin.

A propelling unit is secured to the lengthwise frame members adjacent the bow end of the watercraft. The unit consists of a housed paddle wheel having laterally exposed pedals with the paddle wheel preferably supported by the housing or shield. A rudder is mounted on the rear end of the frame and seating means are attached to an intermediate portion thereof, with a manually operated rudder control adjacent the seating means.

Another objective of the invention is to enable the watercraft to be used by two people, an objective attained with the seating means including back-to-back seats.

Yet another objective of the invention is to enable the watercraft to be propelled by an outboard motor, in practice, because of its relatively light weight, one that is electrically operated, an objective attained by providing the stern end of the frame with a motor mount.

Another objective of the invention is to ensure the easy and convenient operation of the watercraft, whether propelled by its paddle wheel or by a motor, an objective attained with the seating means adjustable lengthwise of the lengthwise frame members.

These and other objectives of the invention will be apparent from the following description of a preferred embodiment, the drawings, and the appended claims.

BRIEF DESCRIPTION OF THE DRAWINGS

The accompanying drawings illustrate a preferred embodiment of the invention

FIG. 8 is a perspective view of the frame with the rudder and its operating means attached thereto;

FIG. 9 is a plan view thereof with the pontoons shown in phantom;

FIG. 10 is a side view thereof;

FIG. 11 is a stern view thereof; and

FIG. 12 is a perspective view of the rudder and the operating means therefor.

THE PREFERRED EMBODIMENT OF THE INVENTION

Figure 1:
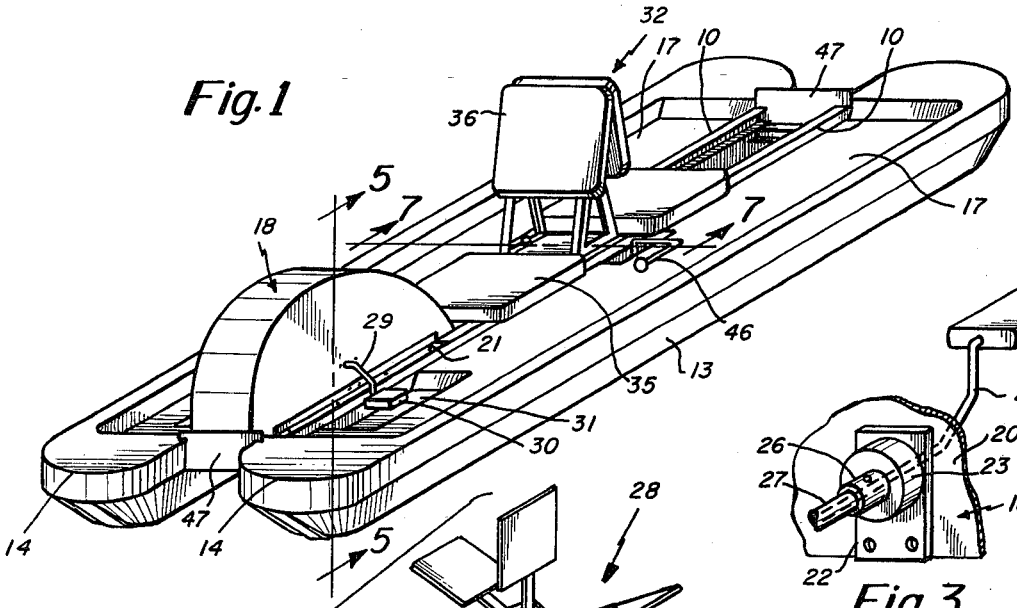
FIG. 1 is a perspective view of a watercraft in accordance with the invention.
Figure 3:
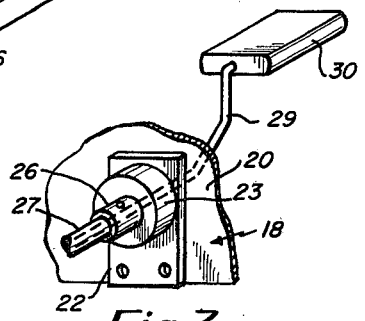
FIG. 3 is a fragmentary view showing the support of the shaft of the propelling means by the housing.
Figure 2:
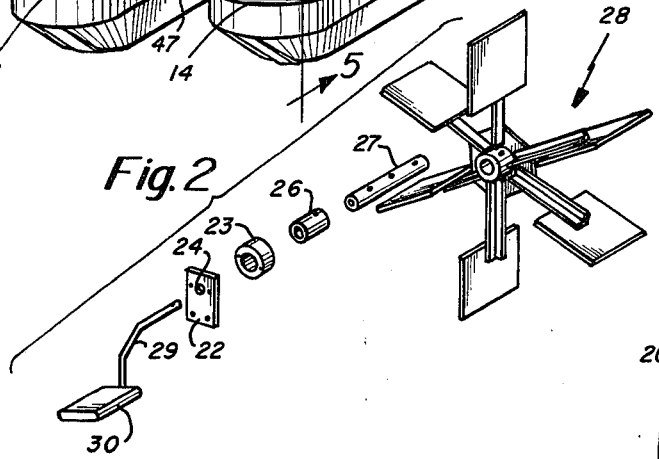
FIG. 2 is an exploded view of components of the propelling unit.
Figure 4:
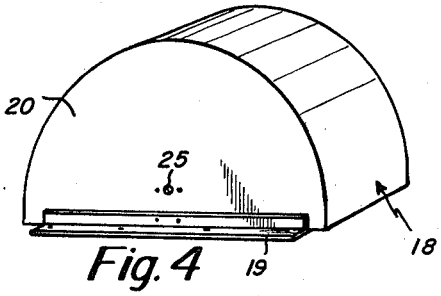
FIG. 4 is a perspective view of the housing or shield by itself.
Figure 6:
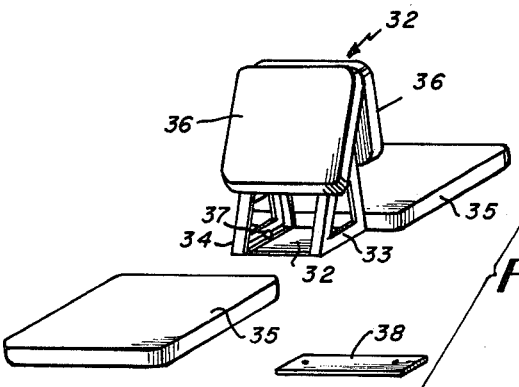
FIG. 6 is a perspective view of the seating means.

The watercraft illustrated by the drawings has a light weight metal frame, see FIGS. 8–11, consisting of two lengthwise members 10 interconnected in parallel, spaced apart relationship by transverse members 11 the ends of which and lengthwise anchor members 12 are molded in the pontoons 13. The members 10, 11, and 12 are formed of channel stock of aluminum, magnesium or alloys thereof.

The pontoons 13 are preferably polystyrene as ensuring adequate flotation and a skin or shell and are molded to provide each with similar bow and stern ends 14 and 15, respectively, a lengthwise bottom rib 16, and a lengthwise upper recess 17 which open along its inner edge and closed by the appropriate one of the lengthwise members 10 to provide a convenient place where equipment can be safely stored.

Figure 5:
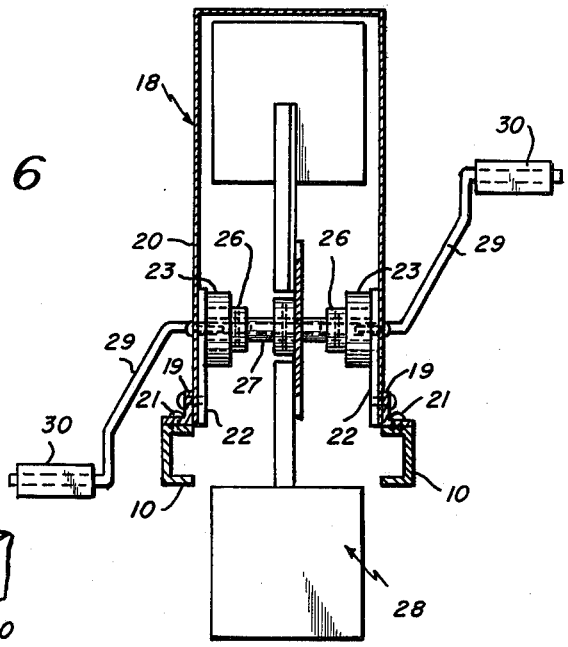
FIG. 5 is a section, on a substantial increase in scale, taken approximately along the indicated line 5—5 of FIG. 1.

A semi-circular housing or shield, generally indicated at 18, has a flange 19 extending along the bottom of each side wall 20 detachably attached to a frame member 10 by screws 21, see FIG. 5. Attached to the inner surface of each side wall 20 is a support 22 for a bearing 23. A bushing 24 within the bearing 23 supports the shaft 25 of a paddle wheel generally indicated at 26 with each end of the shaft 25 extending through the adjacent support 22 and side wall 20 as an exposed crank and provided with a pedal 27. Each recess 17 is formed with a pocket 28 so dimensioned as to accommodate the pedal 27 at that side of the shield 18 as the paddle wheel 26 is turned by the operator when in position so to do.

Figure 7:
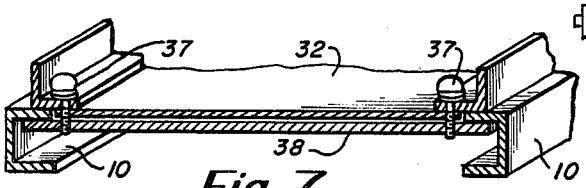
FIG. 7 is a section, on a substantial increase in scale, taken approximately along the indicated line 7—7 of FIG. 1.

The watercraft has a seating unit generally indicated at 29 and consisting of framework and a base having two side members 30, each of right angular section with a framework in support of a rearwardly inclined back rest 31 for a person seated on the flotation cushion 32 resting on the lengthwise members 10 and a forwardly inclined back rest 33 for a person seated on a like and similarly supported cushion 32. As may best be seen in FIG. 7, the members 30 protrude beyond the inner edges of the lengthwise members 10 with thumb screws 34 threaded through their margins and through a clamping plate 35 which is dimensioned to underlie the side members 10 of the framework thus enabling the seating unit 29 to be clamped thereto or released so that it may be slid forwardly or rearwardly and resecured in a selected position.

Centrally of the rearmost frame member 11, see FIGS. 8–12, there is pivoted an arm 36 having at one end a rudder 37. Pivotally connected to the other end of the arm 36 is a forwardly extending rod 38 slidable in a guide 39 attached to the next adjacent transverse member 11 forwardly of which it has a laterally disposed portion 40 entrant of a pocket 41 in the recess 17 of the port pontoon 13. The rod 39 there includes an upwardly bent portion 42 placing its forwardly disposed handle 43 in a position to be easily engaged by the operator and pulled forwardly or pushed rearwardly depending on whether the watercraft is to be turned to the left or the right.

The front and rear ends of the lengthwise members 10 are closed by plates 44. The rear plate 44 serves as a mount to which a light weight outboard motor, not shown, may be secured with its control effected by one occupying the rear seat. It will be appreciated that the seating unit may be moved forwardly or rearwardly as required to enable one to be so seated that the watercraft may be comfortably pedaled and similarly adjusted when an outboard motor is attached if there is to be but one occupant.

Watercraft in accordance with the invention are light in weight and both the propelling unit and the seating unit may be easily removed for convenience in transportation or storage.

I claim:

1. A watercraft including a pair of pontoons of an expanded plastic, a frame including a series of transverse members the ends of which extend into the proximate sides of the pontoons and are incorporated therein and include anchor members embedded in the pontoons and extending lengthwise thereof, said transverse and anchor members holding said pontoons in a parallel, spaced apart relationship, and a pair of lengthwise, spaced apart members connected to said transverse members, each extending along the upper edge of the inner side of the appropriate one of said pontoons, a propelling unit including a paddle wheel provided with a shaft and a pedal connected to each shaft end and a shield overlying said paddle wheel with the pedals exposed at the sides thereof, said unit attached to the fore end of the lengthwise frame members with the paddle wheel between said pontoons, a rudder pivotally supported by the aft end of said frame, a seating means supported by an intermediate part of said lengthwise frame members in a position enabling the feet of a seated person to engage and operate said pedals, the unit sufficiently narrow to enable it to be straddled by the legs of a person seated on said seating means, and manually operated steering means connected to and operable to turn said rudder, said means extending forward into a position laterally of and adjacent said seating means.

2. The watercraft of claim 1 in which the frame members are in the form of channels.

3. The watercraft of claim 2 in which the anchor members are short channel lengths, one for each end of each transverse member.

4. The water craft of claim 1 in which a mount for an outboard motor at its aft end is secured to the rearmost transverse frame member and the aft ends of the lengthwise frame member and extends upwardly above the frame.

5. The watercraft of claim 1 in which the seat includes a flotation cushion supported by said lengthwise members and a unit including a seat back and a pair of support members each having a marginal portion overlapping the proximate edge of the subjacent lengthwise member, a clamping plate underlying said lengthwise members and clamped to said portions to hold said unit in a wanted position lengthwise of said watercraft, and manually operable clamping members interconnecting said marginal portions of said clamping plate.

6. The watercraft of claim 5 in which there is a second flotation cushion supported by said lengthwise members and the unit includes a rear, forwardly inclined back.

7. The watercraft of claim 1 in which the shield of the propelling unit is detachably attached to said frame.

8. The watercraft of claim 1 in which the rudder includes an arm centrally pivoted to the rearmost transverse frame member, a forwardly extending rod pivotally connected to the free end of said arm below the frame, one pontoon having an upwardly opening pocket adjacent the seat, and the rod includes an end portion shaped and disposed to enter said pocket through the side of one pontoon and extend upwardly therefrom and to extend forwardly above the upper surface of said one pontoon for manual engagement.

* * * * *